United States Patent [19]

Natori

[11] Patent Number: 4,805,797

[45] Date of Patent: Feb. 21, 1989

[54] CASING FOR PACKING

[75] Inventor: Eiji Natori, Konosu, Japan

[73] Assignee: Chuo Kagaku Kabushiki Kaisha, Konosu, Japan

[21] Appl. No.: 120,554

[22] Filed: Nov. 13, 1987

[30] Foreign Application Priority Data

Dec. 9, 1986 [JP] Japan ..... 61-189597[U]

[51] Int. Cl.[4] ..... B65D 41/16

[52] U.S. Cl. ..... 220/306; 220/315

[58] Field of Search ..... 220/356, 306, 327, 324, 220/315

[56] References Cited

U.S. PATENT DOCUMENTS 4,280,635 7/1981 Murphy ..... 220/356

4,341,324 7/1982 Ramirez ..... 220/356

4,681,223 2/1987 Roberts ..... 220/356

*Primary Examiner*—Joseph Man-Fu Moy

*Attorney, Agent, or Firm*—Jordan and Hamburg

[57] ABSTRACT

A casing comprises a main body provided with a first fringe that is protruded outwardly from the outer periphery of the opening and a lid provided with an engaging part to be coupled with the first fringe and a second fringe that covers the first fringe. A finger lug is formed on a part of the side wall of the second fringe on the lid. A recess is formed in the rear side of the finger lid to receive an inserted finger. The finger tip can be operated to release the engagement between the first fringe of the casing main body and the engaging part of the lid when the finger tip is placed in the recess.

12 Claims, 4 Drawing Sheets

CASING FOR PACKING

BACKGROUND OF THE INVENTION

The present invention relates to the casing for packing lunch boxes and Sushi packages sold in station Kiosks and other food packages available in supermarkets and fast food shops.

According to the method of creating these types of packages, known in the prior art, various types of plastic sheets, such as semi-hard, solid or foamed, single layered or multi-layered sheets, are sheet-formed by suitable methods, e.g., vacuum forming, pneumatic forming and hot pressing, thereby predetermined preferred shapes are obtained. The materials of these packages consist, for example, of polystyrene, polypropylene, polyethylene, polyvinyl chloride and other plastics. According to other methods for forming the packages based on the prior art include injection molded plastics which small wall thickness and sheet-formed ones with water-proof or oil-proof paper material through hot pressing.

Some casings for packing, used in the marketplace at present, are equipped with lids. These lids are attached to the fringe of the opening in the main body of the casing. The structure of this mounting is shown in FIG. 3.

Around the opening of casing main body 1, fringe 1*a* is protruded outwardly. In the outer periphery of lid 2, fringe 2*a* is formed while covering fringe 1*a* from the upper part. Fringe 2*a* is provided with inwardly faced engaging projections 2*b* that can engage with the lower face or lower edge of fringe 1*a* along the entire length of fringe 2*a* or at several locations in suitable intervals. Fringe 1*a* engages with engaging projections 2*b* to fix the lid onto casing main body 1.

Such holding, considerably secured, is advantageous in that the lid is not easily opened from the packing casing. However, its disadvantage is that the lid is not easily opened manually as set forth in detail in the following.

Referring to FIG. 3, opening of lid 2 is effected as follows. Fringe 2*a* of the lid covers fringe 1*a* of casing main body 1. Therefore a person's finger cannot grip fringe 1*a*. Consequently, the side wall of the casing main body should be gripped and fixed with one hand, while a part of fringe 2*a* is extended with thumb A and forefinger B of the other hand, as shown by the chain lines in FIG. 3. Thereby, the engaged part with fringe 1*a* is disengaged by deflection. At that time, the part where fringe 2*a* is disengaged is extremely local. Therefore, the entire body of lid 2 cannot be removed so easily from casing main body 1. If lid 2 is attempted forcefully to be removed from casing main body 1, lid 2 or casing main body 1 is torn or deformed unrecoverably. In other disadvantageous circumstances, the casing itself is so largely deformed that the layout of the housed foods comes in disorder or the casing may be dropped from the hands.

In order to prevent such disadvantages, the part engaged with casing main body 1 must be sequentially and locally disengaged by bending and widening consecutively along the edge of fringe 2*a* of lid 2, in suitable intervals. However, such operations require a very long time and tedious labor for opening the lid. The foregoing disadvantages become more significant where casing main body 1 is formed in a shallow tray that cannot be securely gripped for opening the lid.

SUMMARY OF THE INVENTION

The casing for packing, according to the present invention, comprises a casing main body in which a fringe is formed protruding outwardly around the outer periphery of the opening. The casing is also provided with a lid in which an engaging part to be coupled with said fringe is formed and another fringe is formed to cover said fringe and a finger lug that is outwardly protruded and located at a part of the periphery of the lid fringe. Another important component, formed on the finger lug, is a recess located in the rear part of the finger lug and can accommodate a finger tip. The finger tip, when being set in the recess, can release the engagement between the engaging part of the lid and the fringe of the casing main unit, by pressing the peripheral wall of the fringe in said casing main unit.

An object of the present invention is to provide a casing for packing, whose lid can be easily and tolerably opened.

The features of the invention will be better understood by describing referring to the drawings.

BRIEF DESCRIPTION OF THE DRAWINGS

FIG. 1(*a*) is a partial cutaway front view with the lid closed. FIG. 1(*b*) is a plan view of the casing main body. FIG. 1(*c*) shows a plan of the lid, while FIG. 1(*d*) shown an enlarged sectional view for the engagement between fringes. FIG. 1(*e*) is also an enlarged section with the engagement between the fringes released.

DESCRIPTION OF THE PREFERRED EMBODIMENT

Figure 1A:
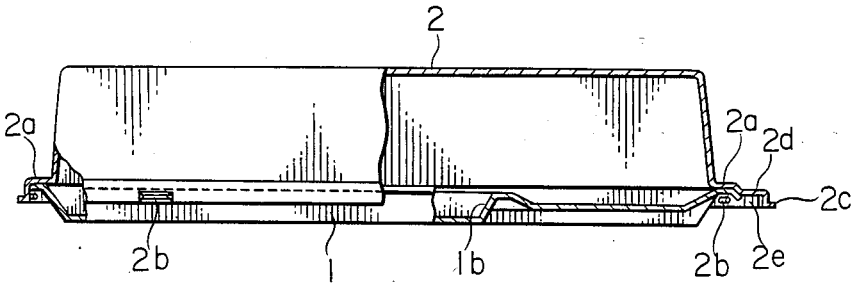
FIG. 1(*a*) through FIG. 1(*e*) show an embodiment of the present invention.
Figure 1C:
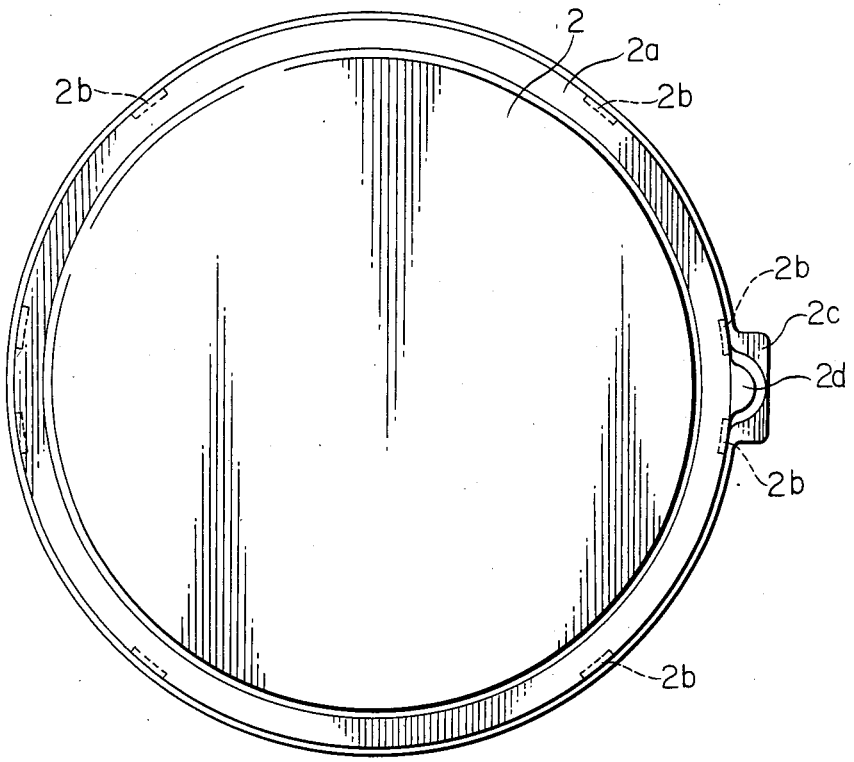

A description is given by way of an example of a dish casing for enclosing hors d'oeuvre, Sushi, etc. Referring to FIGS. 1(*a*) and (*b*), casing main body 1 is formed by a sheet forming method using hard or semi-hard plastic sheet, with a diameter of about 310 mm and a depth of about 17 mm in a round tray. On the outer periphery of casing main body 1, a fringe 1*a*, having a substantially semi-circular arc section as shown in FIG. 1(*d*) is protruded outwardly. On the dish face in casing main body 1, elevated rib 1*b* is protruded for partitioning the interior of the casing main body into several small chambers.

Lid 2 is formed in a plain circle with the same material as casing main unit 1, with a peripheral wall height of about 55 mm. Fringe 2*a* is formed on the outer periphery of the lower opening of lid 2, in such a way that fringe 2*a* covers the upper part of fringe 1*a* extended from casing main body 1. Inwardly faced engaging projections 2*b* are equipped protrudedly at several locations as required (7 positions in the drawing) at suitable intervals along the outer periphery of the side wall of fringe 2*a*. With lid 2 closed, engaging projections 2*b* are engaged with the lower edge of fringe 1*a* of casing main body 1 as shown in FIG. 1(*d*), such that lid 2 is thereby fixed and maintained onto casing main body 1.

A finger lug 2c is outwardly protruded on a part of the side wall of fringe 2a in lid 2. This finger lug 2c contains an elevated part 2d whose upper face is raised upwardly. The rear side of this elevated part is formed as a downwardly faced recess 2e. The size of elevated part 2d is satisfactory to house a finger tip in downwardly faced recess 2e as shown in FIG. 1d. When lid 2 is engaged with the main body of the casing, the finger tip can push the side wall of fringe 1a in the casing main body by inserting the finger tip in this recess 2e. In addition, the finger tip can be forcefully inserted between engaged fringes 1a and 2a.

Next, opening/closing operations of the lid are described in the following.

Assume lid 2 is engaged with casing main body 1 as shown in FIG. 1(a). Then opening operations of this lid are described as follows.

A thumb A is placed on the upper side of elevated part 2d of finger lug 2c while inserting forefinger B into downwardly faced recess 2e in the rear side of the elevated part, thereby gripping the elevated part (FIG. 1(d)). In this state of gripping, the nail of forefinger B comes in contact with fringe 1a in casing main body 1 side.

Figure 1E:
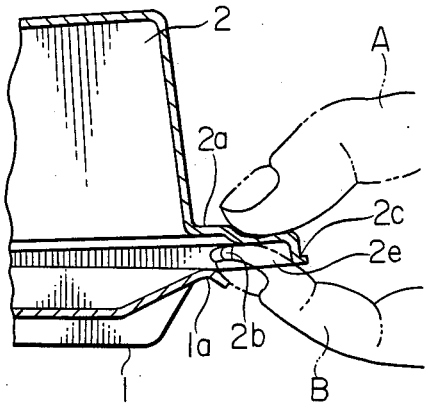
Figure 1D:
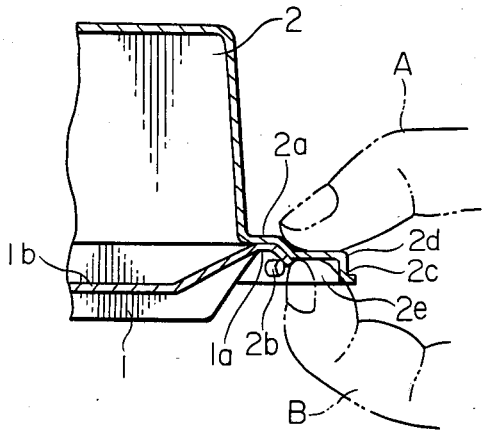
Figure 1B:
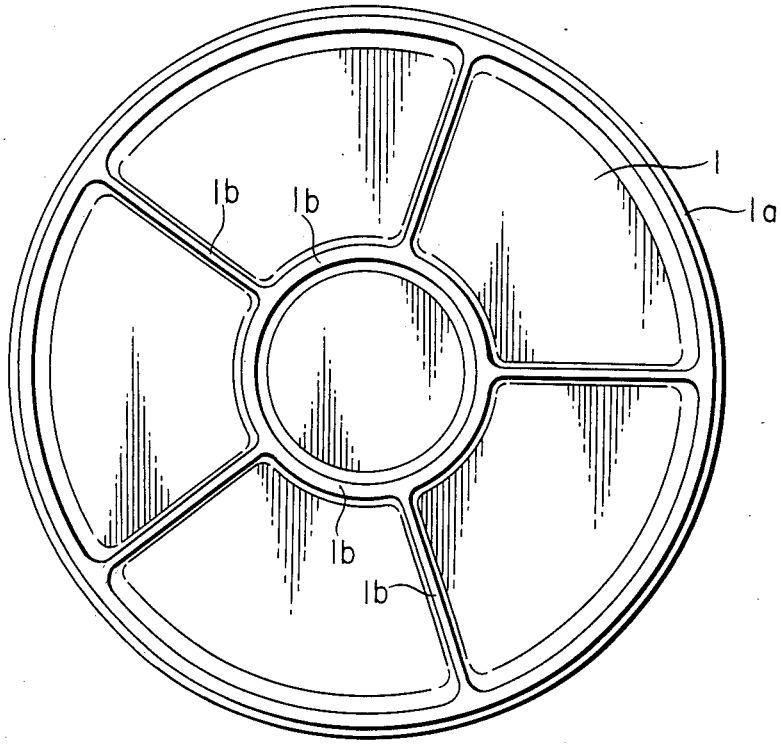

At that time, gripped finger lug 2c is slightly pushed upwardly and, while pressing the side wall of fringe 1a in casing main body 1 side by means of the nail of forefinger B, the finger tip of forefinger B is forcefully pushed in between fringes 1 and 2a (FIG. 1(e)). Thus, a wide range in the fringe 2a parts in the left and right sides of lid 2 are deflected in such a direction that fringe 2a is disengaged from fringe 1a in the casing main body 1 side, with finger lug 2c located at the center of the range. Thereby, the entire body of lid 2 is simultaneously floated from casing main body 1 and disengaged from the casing.

In the operations above, the operator need not grip and press the main body of the casing with his hands. Therefore, users can easily and quickly open lid 2 even where casing main body 1 comprises a shallow tray or such a form that gripping of the casing is difficult or even impossible.

Next, closing operations for the main body of the casing with lid 2 is described. With this lid covered onto the opening of the main body, fringe 2a of the lid covers fringe 1a of the main body of the casing. Referring to FIG. 1(d), engaged projections 2b are engaged with the lower edge of fringe 1a, such that the lid is fixed onto the main body of the casing.

The number of positions, where finger lug 2c is located, may be only 1 as shown in the embodiment above. However, the finger lugs may also be located at 2 positions opposed by about 180°. Three or more lugs may also be used if required.

Figure 2A:
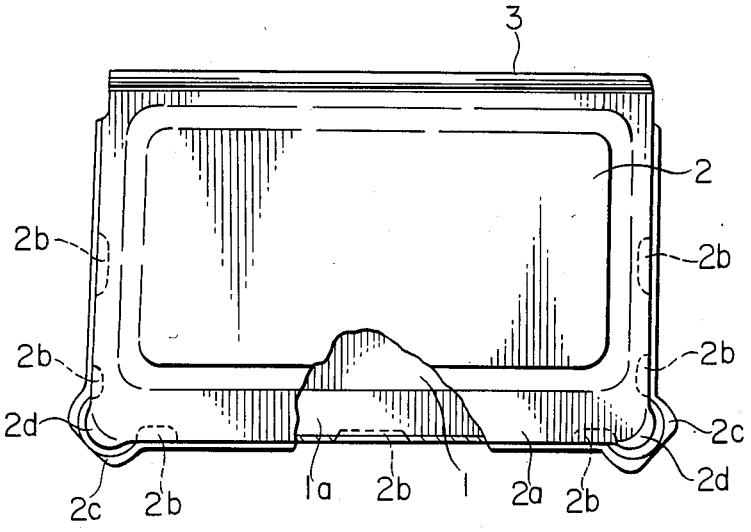
FIG. 2(*a*) through FIG. 2(*b*) show another embodiment of the invention, showing partial cutaway plan and front views, respectively.
Figure 2B:
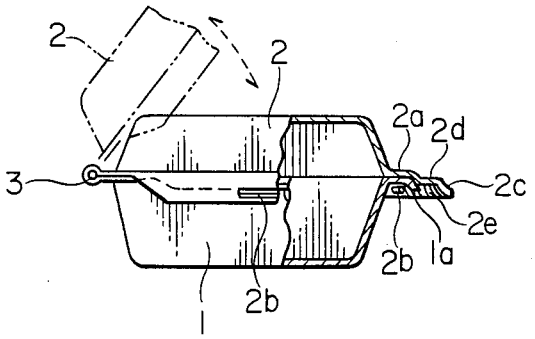
Figure 3:
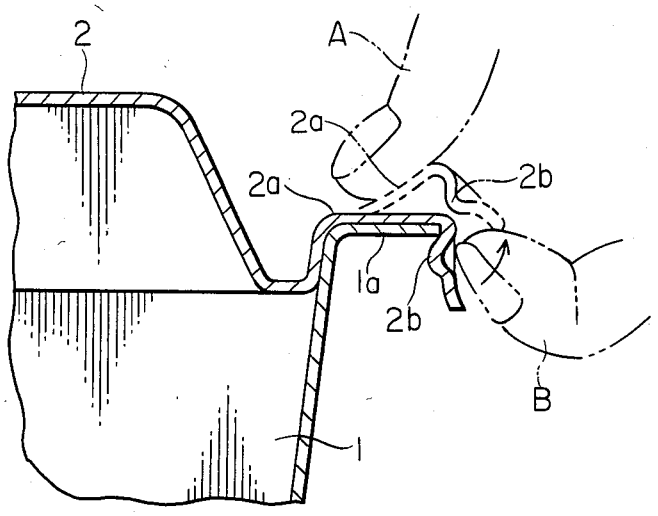
FIG. 3 is a sectional view of a part of conventional example known in the prior art.

FIGS. 2(a) and (b) show another embodiment. With this embodiment, lid 2 is integratedly connected to casing main body 1 through hinge 3. Lugs 2c, similar to that in the foregoing embodiment, are equipped in the 2 left and right corners, opposite to hinge 3 of the lid. The structure for engaging lid 2 with casing main body 1 is substantially the same as the foregoing embodiment. Opening/closing operations of the lid are also the same as the foregoing embodiment.

I claim:

1. A packing casing comprising a main body having an opening and an outer main body fringe protruding outwardly from said opening, a lid releasably secured to said main body, said lid having a lid fringe, said lid fringe having an outwardly extending portion and a depending portion depending downwardly from said outwardly extending portion, said main body fringe having an upper face, a lower face, and an outer boundary edge, said outwardly extending portion of said lid fringe being superimposed on said upper face of said main body fringe, said depending portion of said lid fringe being disposed about said outer boundary edge of said main body fringe, inner protrusion means extending inwardly from said depending portion to a position underlying said lower face of said main body fringe such that said main body fringe is disposed between said underlying inner protrusion means and said overlying outwardly extending portion of said lid fringe, said lid fringe having an outwardly extending finger part which extends outwardly beyond said depending portion of said main body fringe and which enables a person's finger to be positioned underneath said outwardly extending finger part to simultaneously engage both said outwardly extending finger part and said main body fringe to effect separation between said lid and said main body.

2. A packing casing according to claim 1, wherein said main body fringe has a superimposing finger part underlying said outwardly extending finger part of said lid fringe, said superimposing finger part having an outer terminating edge, said outwardly extending finger part of said lid fringe extending outwardly beyond said terminating edge such that a person's finger can be positioned underneath said outwardly extending finger part to engage said terminating edge and effect separation between said lid and said main body.

3. A packing casing according to claim 2, wherein said lid fringe has a plurality of outwardly extending finger parts spaced from one another along said lid fringe and said main body fringe has a plurality of spaced superimposing finger parts spaced from one another along said main body fringe to thereby provide a plurality of spaced pairs of outwardly extending finger parts and superimposing finger parts, said inner protrusion means comprising a plurality of spaced protrusions which are disposed in the space between said spaced pairs of outwardly extending finger parts and superimposing finger parts.

4. A packing casing according to claim 2, wherein said outwardly extending finger part of said lid fringe has an outwardly extending first section, a generally downward depending inclined second section extending at an obtuse angle from said first section, and an outwardly extending third section extending from said second section, said superimposing finger part having an outwardly extending first portion and a generally downwardly depending inclined second portion extending at an obtuse angle from said first portion, said first and second portions of said superimposing finger part underlying said first and second sections of said outwardly extending finger part.

5. A packing casing according to claim 4, wherein said obtuse angle of said second section is substantially equal to said obtuse angle of said second portion.

6. A packing casing according to claim 4, wherein said outwardly extending finger part has a fourth section downwardly depending from said third section, said inclined second portion of said superimposing finger part having an outer edge defined by said outer terminating edge, said downwardly depending fourth section being spaced from said terminating edge a distance to enable a person's finger to be positioned in said space between said terminating edge and said downwardly depending fourth section.

7. A packing casing according to claim 1, wherein said depending portion of said lid fringe has a inner face and an outer face, said inner protrusion means comprising a plurality of spaced protrusions extending inwardly from spaced locations of said inner face.

8. A packing casing according to claim 7, wherein said outwardly extending finger part is located in the space between said protrusions.

9. A packing casing according to claim 1, wherein said outwardly extending portion of said lid fringe has at least two sections, said outwardly extending finger part being disposed between said at least two sections.

10. A packing casing according to claim 1, wherein said outwardly extending finger part of said lid fringe extends outwardly beyond said outwardly extending portion of said lid fringe.

11. A packing casing according to claim 1, wherein said depending portion of said lid fringe is juxtaposed to said outer boundary edge of said main body fringe.

12. A packing casing comprising a main body having an opening and an outer main body fringe protruding outwardly from said opening, a lid releasably secured to said main body, said lid having a lid fringe, said lid fringe having an outwardly extending portion and a depending portion depending downwardly from said outwardly extending portion, said main body fringe having an upper face, a lower face, and an outer boundary edge, said outwardly extending portion of said lid fringe being superimposed on said upper face of said main body fringe, said depending portion of said lid fringe being disposed about said outer boundary edge of said main body fringe, inner protrusion means extending inwardly from said depending portion to a position underlying said lower face of said main body fringe such that said main body fringe is disposed and sandwiched between said underlying inner protrusion means and said overlying outwardly extending portion of said lid fringe, said lid fringe having an outwardly extending finger part which extends outwardly beyond said depending portion of said main body fringe and which enables a person's finger to be positioned underneath said outwardly extending finger part to effect separation between said lid and said main body.

* * * * *